US005947758A

United States Patent [19]

Enck

[11] Patent Number: 5,947,758

[45] Date of Patent: Sep. 7, 1999

[54] HIGH RELIABILITY HIGH VOLTAGE CONNECTION SYSTEM

[75] Inventor: Richard S. Enck, San Jose, Calif.

[73] Assignee: Kevex X-Ray, Inc., Scotts Valley, Calif.

[21] Appl. No.: 08/916,022

[22] Filed: Aug. 21, 1997

Related U.S. Application Data

[63] Continuation of application No. 08/289,899, Aug. 12, 1994, abandoned.

[51] Int. Cl.[6] ..... H01R 13/53

[52] U.S. Cl. ..... 439/181; 439/587

[58] Field of Search ..... 439/181, 183, 439/587, 589, 274, 275, 279, 921

[56] References Cited

U.S. PATENT DOCUMENTS

| | | | |
|---|---|---|---|
| 3,761,863 | 9/1973 | Straus | 439/589 |
| 3,904,264 | 9/1975 | Oertle | 439/587 |
| 3,963,297 | 6/1976 | Panek et al. | 439/589 |
| 4,427,256 | 1/1984 | Reif et al. | 439/181 |
| 4,959,022 | 9/1990 | Neuroth | 439/589 |

*Primary Examiner*—Hien Vu
*Attorney, Agent, or Firm*—Benman & Collins

[57] ABSTRACT

A high voltage connection assembly for connecting a high voltage source to a high voltage device and inhibiting ionic conduction between a first and second points. The inventive system includes a first mechanism for providing a voltage potential between the first and second points and a second mechanism for providing discrete segments of insulation against the ionic conduction between the first and second points. In a particular embodiment, the high voltage connection assembly of the invention uses a plurality of equally spaced square grooves on the insulation of a high voltage cable to receive a plurality of O-rings. These O-rings, located between a cable well housing the insulated high voltage cable and the insulated high voltage cable, provide discrete segments of insulation between a first point and a second point thereby inhibiting the occurrence of high voltage arcing and leakage.

10 Claims, 2 Drawing Sheets

HIGH RELIABILITY HIGH VOLTAGE CONNECTION SYSTEM

This application is a continuation of 08/289,899 filed Aug. 12, 1994, now abandoned.

BACKGROUND OF THE INVENTION

1. Field of the Invention

The present invention relates to high voltage wire connections. More specifically, the present invention relates to high voltage wire connections for X-ray generating vacuum tubes.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

2. Description of the Related Art

Many electronic devices contain components that require high voltages (e.g., voltages in the range of 125 KV). To power these devices, a connection has to be made between the component and a high voltage power source. Customarily, a high voltage cable supplies power to a high voltage connector. A high voltage connector typically includes a high voltage cable, a cable well to house the high voltage cable, a tube contact to effectuate the connection with the high voltage device, a stress cone to position the cable well from an end plate and a cable retainer.

Conventional high voltage connectors use a purified high voltage grease in the gap between the high voltage cable and the cable well to prevent high voltage arcing.

However, the purified grease can become contaminated or degraded due to temperature and pressure fluctuations and/or repetitive disconnections and reconnections to the high voltage component. As a result, high voltage arcing often occurs which may lead to a failure of the connector.

Another conventional high voltage connector is the dry well connector. As the name suggests, the dry well connector does not use purified high voltage grease to prevent high voltage arcing. Instead, the body of the connector is lengthened to reduce high voltage stress and thereby precludes high voltage arcing. Although the dry well connectors are currently used in many systems, they may not be used in systems necessitating small connectors.

Therefore, a need remains in the art for a small, reliable high voltage connector that does not require purified high voltage grease as an inhibitor of high voltage arcing and leakage.

SUMMARY OF THE INVENTION

The need in the art is addressed by the present invention which provides a high voltage connection assembly for connecting a high voltage source to a high voltage device and inhibiting ionic conduction between first point located at a first end of the assembly and a second point located at a second end of the assembly. The inventive system includes a first mechanism for providing a voltage potential between the first and second points and a second mechanism for providing discrete segments of insulation against the ionic conduction between the first and second points.

In a particular embodiment, the invention has a plurality of O-rings in equally spaced square grooves on the insulation of the cable. The O-rings are located between a cable well which houses the cable and the insulation thereof to provide discrete segments of insulation.

DESCRIPTION OF THE INVENTION

Illustrative embodiments and exemplary applications will now be described with reference to the accompanying drawings to disclose the advantageous teachings of the present invention.

Figure 1:
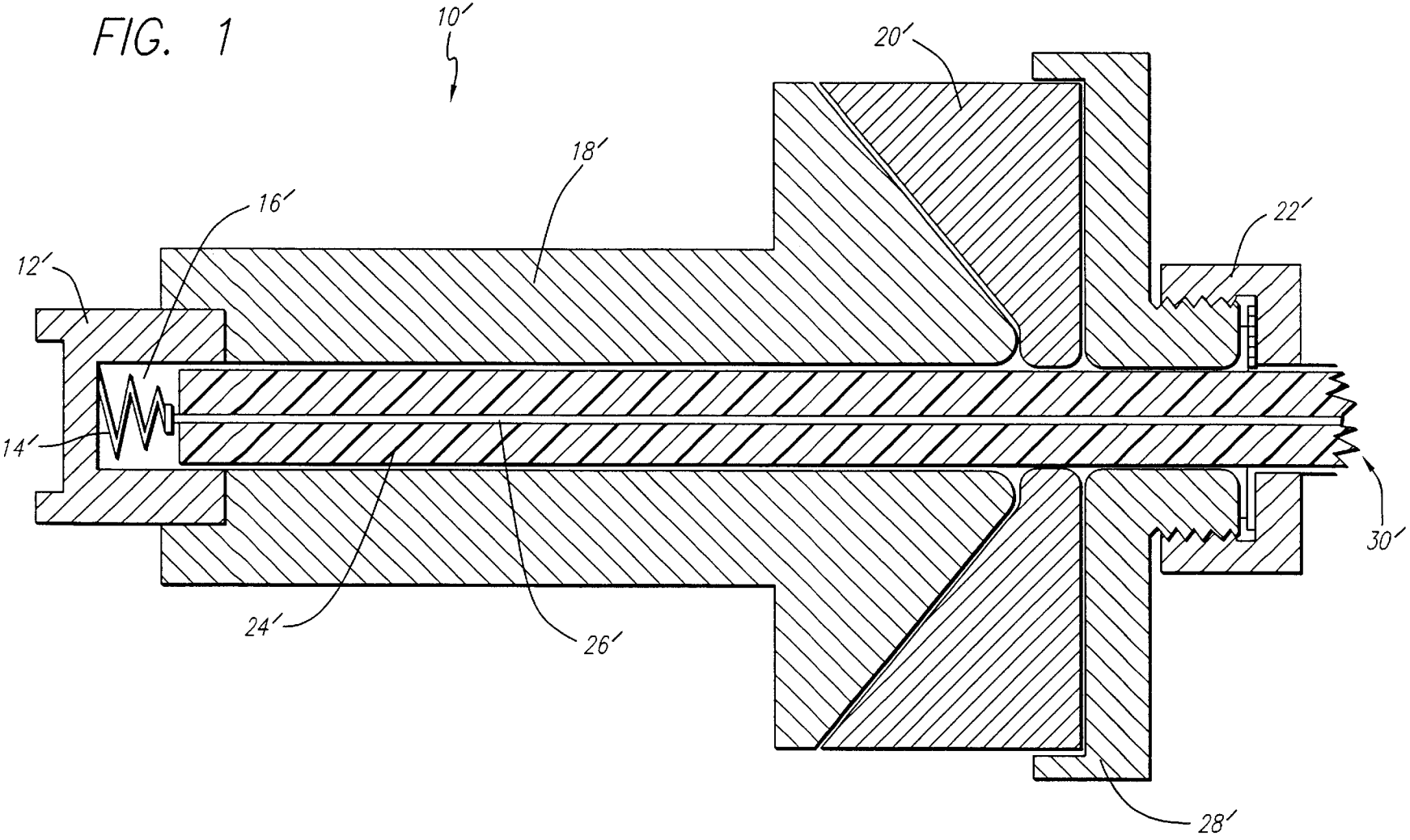
FIG. 1 is a simplified sectional side view of a conventional high voltage connector.

FIG. 1 is a simplified sectional side view of a high voltage connector 10' used to connect an X-ray generating tube (not shown) to a high voltage source. The electrical connection of the high voltage connector 10' comprises a high voltage cable 30', a contact spring 14' and a tube contact 12'.

As is illustrated in FIG. 1, the cable 30' comprises a center conductor 26' and a high voltage insulator 24'. The center conductor 26' is coupled to the contact spring 14'. In this embodiment, the high voltage connection is made at the tube contact 12'. The tube contact 12' is a metal socket structure designed to adapt to an electrode of a load, in this case, the X-ray generating tube (not shown). The tube contact 12' also houses the contact spring 14'.

As shown in FIG. 1, a cable well 18' serves as a housing for the cable 30' and holds the tube contact 12' in place. A stress cone 20' located between the cable well 18' and an end plate 28' retains the cable well 18'. The cable well 18' is made of an insulating material and thus enables the tube contact 12' to operate at a high voltage while the stress cone 20' and the end plate 28' operate at ground potential. A cable retainer 22' retains the cable 30' into the cable well 18'.

The high voltage connector 10' typically has a gap in the area of the tube contact 12' and a clearance between the cable 30' and the cable well 18'. The gap allows the contact spring 14' to compress and thus facilitates the connection between the load and the high voltage connector 10'. The clearance allows for the insertion of the cable 30' into the cable well 18'.

Although the gap is of no consequence as there is no appreciable high voltage field gradient in that area, the clearance may be a catalyst for high voltage breakdowns. Ordinarily, a high voltage (typically 125 KV) exists at the contact spring 14' whereas a zero voltage potential is at the stress cone 20'. Due to this high voltage gradient, the air in the clearance will become ionized. This ionization will eventually lead to a high voltage breakdown.

To inhibit the ionization of the air in the clearance, a common practice in the field has been to fill in the clearance with a purified high voltage grease 16'. This is accomplished by first adding the purified high voltage grease 16' to the cable well 18'. The cable 30' is then inserted into the cable well 18' forcing the purified high voltage grease 16' to thoroughly fill in the clearance as well as the gap as shown in FIG. 1.

Unfortunately, as will be explained below, the purified high voltage grease 16' eventually develops gaps that may lead to a system failure. In addition, the purified high voltage grease 16' can become contaminated by dirt when the high voltage connector 10' is serviced.

When the ambient pressure or temperature fluctuates, the purified high voltage grease 16' may develop gaps. For example, when the pressure is reduced or the temperature is increased, the high voltage grease 16' is expanded into holes in the area of the stress cone 20' and into holes at the end plate 28'. After the pressure or temperature has returned to normal, the high voltage grease 16' contracts and forms gaps along the sides of the cable well 18' as the grease is too viscous to flow back into the cable well 18' from the holes in the stress cone 20' and end plate 28'.

These newly formed gaps contain a high voltage field gradient. As mentioned earlier, a potential of 125 KV and a zero volt (ground potential) exist at the tube contact 12 and at the stress cone 20 respectively. This high voltage gradient ionizes the air in the gaps and ultimately leads to high voltage breakdowns. As these high voltage breakdowns occur, a carbon residue is left along the sides of the cable well 18 and the high voltage cable 30. The carbon residue fosters further arcing and high voltage leakage between the tube contact 12' and the stress cone 20'. The arcing and high voltage leakage steadily worsen and ultimately cause a system failure by shorting out the high voltage power supply.

Furthermore, when the cable 30' is removed from the cable well 18' for service or replacement, the high voltage grease 16' may become contaminated by dirt or gaps may develop in the high voltage grease 16'. When either the contamination occurs or gaps are formed in the grease 16', it is necessary to remove the high voltage grease 16' from the cable well 18'. However, because of the many crevices in the high voltage connector 10', the process of removing all traces of the old grease is time consuming and very difficult to accomplish even in clean factory conditions. Consequently, all of the old grease may not be totally removed and thus may become a source of contamination that may contribute to a system failure.

Therefore, there is a need in the art for a compact high voltage connector that does not require the use of a purified high voltage grease as insulation against high voltage arcing and leakage. This need in the art is addressed by the system of the present invention.

Figure 2:
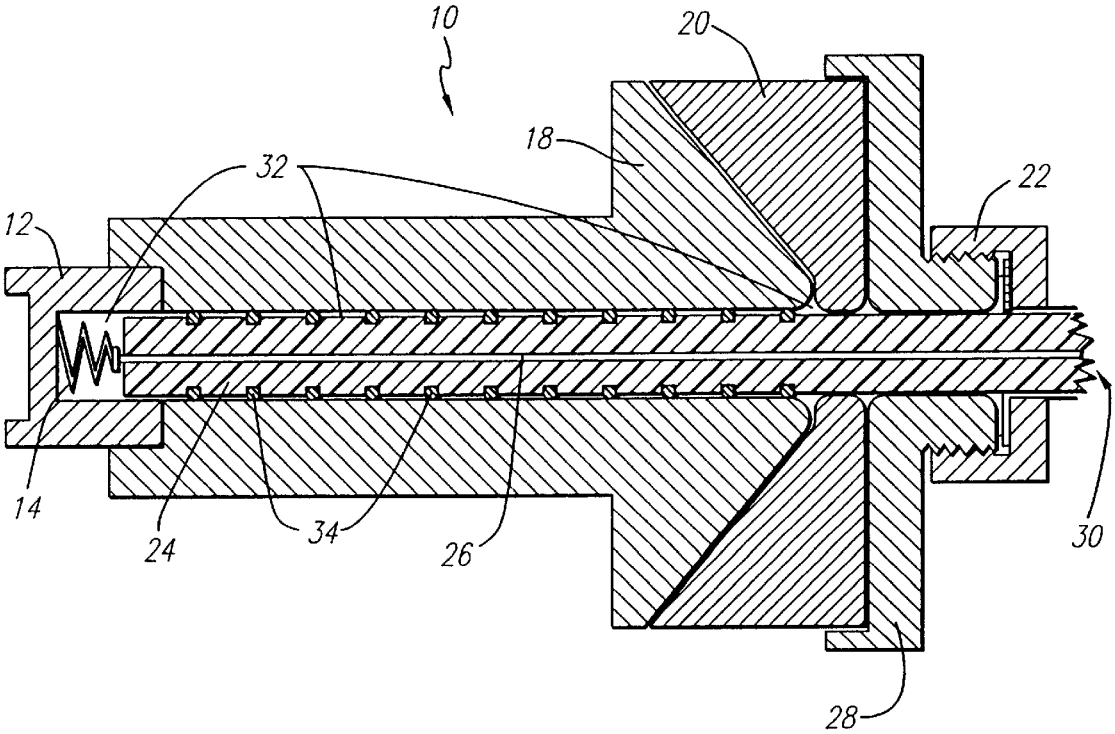
FIG. 2 is a simplified sectional side view of a high voltage connector using the teachings of the present invention.

FIG. 2 is a simplified sectional side view of a high voltage connector using the teachings of the present invention. Except for the purified high voltage grease 16', the high voltage connector 10 of FIG. 2 contains the same basic elements as the conventional high voltage connector 10' of FIG. 1.

Figure 3:
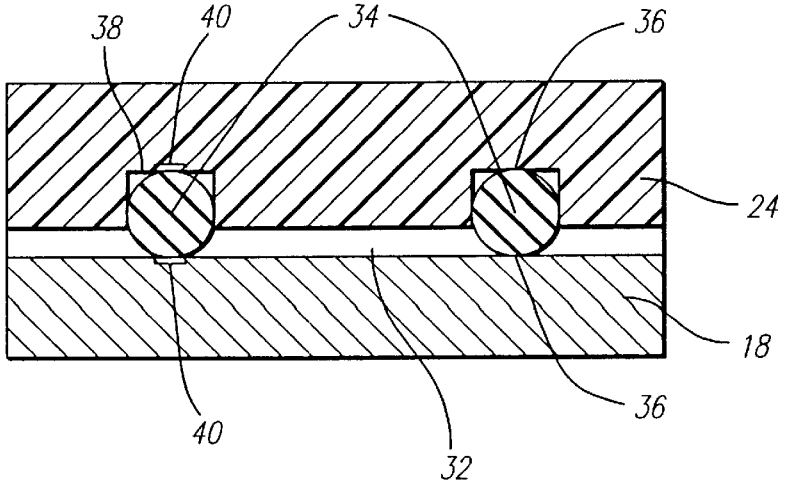
FIG. 3 is a detail view of a sealing zone using the teachings of the invention.

As shown in FIG. 2, the present invention contains a plurality of silicon rubber O-rings 34. The O-rings 34 are placed along the length between the cable 30 and the cable well 18. As is depicted in FIG. 3, the O-rings 34 are retained by square cut grooves 38 in the high voltage insulator 24. The square cut grooves 38 and the size of the O-rings 34 are so configured to create seal zones 36. A seal zone is the contact area between an O-ring 34 and the cable well 18 and between the O-ring 34 and the high voltage insulator 24. To facilitate the insertion of the cable 30 into the cable well 18 a light coating of grease may be used.

The present invention prevents the air in the clearance between the high voltage insulator 24 and the cable well 18 from ionizing by dividing the high voltage gradient resident in the clearance (i.e., 125 KV at the contact spring 14 and zero volt at the stress cone 20) into discrete segments of lower voltage. The number of O-rings 34 is selected to produce approximately 10 KV of potential between each adjacent seal zone 36. Hence, a 125 KV system would utilize 12 or 13 equally spaced O-rings 34.

This 10 KV potential is divided between the air gaps 32 (located between seal zones 36) and the seal zones 36. The division of potential is determined by the relative electronic resistances of the air gaps 32 and the seal zones 36.

The resistance of each seal zone 36 is determined by the bulk resistance of the silicone rubber. Typically, this resistance is in the order of $10^{12}$ ohms and is quite stable (i.e., the resistance varies less than one order of magnitude ($<\times 10$)). However, the resistances of the air gaps 32 vary substantially with temperature, pressure and/or voltage (i.e., much greater than one order of magnitude ($>>\times 10$)). The resistances of the air gaps 32 and the seal zones 36 equalize randomly based on variations of starting environmental and mechanical conditions. If the resistance of an air gap 32 and a seal zone 36 are equal, a 5 KV potential exists across each. As conditions change, the voltage across the air gap 32 can vary from as little as zero volts to as much as the full 10 KV potential, although each extreme is unlikely. Note that the voltage across the seal zone 36 is inversely related to the voltage across the air gap 32 and thus will vary inversely with the variation of the voltage across the air gap 32.

The width 40 of the seal zone 36 is chosen to allow the full 10 KV potential to exist across each seal zone 36 without adverse affect. In this illustrative embodiment, the seal zone width is approximately 1 mm. This width is capable of withstanding about 20 KV without a voltage breakdown. Hence, the inventive design contains a relatively high safety factor. Note that the self compensation of voltage described above occurs independently for each air gap/seal zone region. The 20 KV withstanding potential is additive and thus 12 O-rings can withstand 240 KV.

It should be noted that the invention is intended for use with DC potentials. In AC potentials, the high voltage divider effect, explained above, is determined by capacitance as well as resistance. Low capacitance of air gaps will support high AC potentials which can cause ionization and lead to subsequent failure of the connection system.

Thus, the present invention has been described herein with reference to a particular embodiment for a particular application. Those having ordinary skill in the art and access to the present teachings will recognize additional modifications, applications and embodiments within the scope thereof. For example, the seal zones can be established by numerous means other than the O-rings described above.

It is therefore intended by the appended claims to cover any and all such applications, modifications and embodiments within the scope of the present invention. Accordingly,

What is claimed is:

1. A high voltage connection assembly for connecting a high voltage source to a high voltage device and inhibiting ionic conduction between a first point located at a first end of said assembly and a second point located at a second end of said assembly, said assembly comprising:

first means for providing a voltage potential (V) between said first and second points, said first means including a high voltage conductor and an insulator around said conductor and second means, including a plurality of O-ring seals around said insulator around said conductor, for providing n discrete segments of insulation against said ionic conduction between said first and second points, the number of discrete segments n being chosen so that $V_s$ is below an ionic conduction breakdown potential for each segment given the voltage potential V between said first and said second points and each of said n segments of insulation being spaced to provide a voltage potential between any two adjacent segments ($V_s$) which is much much less than V.

2. The invention of claim 1 wherein said assembly further comprises a contact spring coupled to said conductor.

3. The invention of claim 2 wherein said assembly further comprises a tube contact housing said contact spring.

4. The invention of claim 3 wherein said assembly further comprises a cable well serving as a housing for said insulated cable.

5. The invention of claim 4 wherein said assembly further comprises an end plate to retain said cable well.

6. The invention of claim 5 wherein said assembly further comprises a stress cone to further retain said cable well from said end plate.

7. The invention of claim 6 wherein said assembly further comprises a cable retainer to retain said insulated cable.

8. The invention of claim 1 wherein said insulator contains a plurality of square cut grooves to receive said O-ring seals.

9. A high voltage connection assembly for connecting a high voltage source to a high voltage device and inhibiting ionic conduction between a first point located at a first end of said assembly and a second point located at a second end of said assembly, said assembly comprising:

first means for providing a voltage potential (V) between said first and second points, said first means including a high voltage conductor and an insulator around said conductor and second means, including a plurality of O-ring seals around said insulator around said conductor, for providing n discrete segments of insulation against said ionic conduction between said first and second points, each of said n segments of insulation being spaced to provide a voltage potential between any two adjacent segments ($V_s$) which is much much less than V and so that $V_s$ is below an ionic conduction breakdown potential for each segment given the voltage potential V between said first and said second points.

10. A high voltage connection assembly for connecting a high voltage source to a high voltage device and inhibiting ionic conduction between a first point located at a first end of said assembly and a second point located at a second end of said assembly, said assembly comprising:

first means for providing a voltage potential (V) between said first and second points, said first means including a high voltage conductor and an insulator around said conductor and second means, including a plurality of O-ring seals around said insulator around said conductor, for providing n discrete segments of insulation against said ionic conduction between said first and second points, the number of discrete segments n being chosen so that $V_s$ is below an ionic conduction breakdown potential for each segment given the voltage potential V between said first and said second points and each of said n segments of insulation being spaced to provide a voltage potential between any two adjacent segments ($V_s$) which is much much less than V.

* * * * *